US010663919B2

(12) United States Patent
Sato

(10) Patent No.: US 10,663,919 B2
(45) Date of Patent: May 26, 2020

(54) IMAGE FORMING APPARATUS INCLUDING OPTICAL PRINT HEAD

(71) Applicant: CANON KABUSHIKI KAISHA, Tokyo (JP)

(72) Inventor: Kazumi Sato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/450,710

(22) Filed: Jun. 24, 2019

(65) Prior Publication Data

US 2020/0004200 A1 Jan. 2, 2020

(30) Foreign Application Priority Data

Jun. 27, 2018 (JP) ..... 2018-121705

(51) Int. Cl.

| | |
|---|---|
| ***G03G 21/20*** | (2006.01) |
| ***G03G 15/043*** | (2006.01) |
| ***G03G 21/16*** | (2006.01) |
| ***G03G 15/04*** | (2006.01) |
| ***G03G 15/00*** | (2006.01) |
| ***G03G 15/01*** | (2006.01) |

(52) U.S. Cl.

CPC ..... *G03G 21/20* (2013.01); *G03G 15/011* (2013.01); *G03G 15/043* (2013.01); *G03G 15/04036* (2013.01); *G03G 15/80* (2013.01); *G03G 21/1666* (2013.01); *G03G 15/04054* (2013.01); *G03G 15/04063* (2013.01); *G03G 21/1652* (2013.01); *G03G 2215/0402* (2013.01); *G03G 2215/0409* (2013.01); *G03G 2221/169* (2013.01); *G03G 2221/1636* (2013.01); *G03G 2221/1651* (2013.01)

(58) Field of Classification Search

CPC ..... G03G 15/011; G03G 15/043; G03G 15/04036; G03G 15/04045; G03G 15/04054; G03G 15/04063; G03G 15/04072; G03G 15/80; G03G 21/20; G03G 21/1647; G03G 21/1652; G03G 21/1666; G03G 2215/0402; G03G 2215/0409; G03G 2221/1636; G03G 2221/1651; G03G 2221/166; G03G 2221/169

See application file for complete search history.

(56) References Cited

U.S. PATENT DOCUMENTS

| | | | | |
|---|---|---|---|---|
| 8,781,357 | B2 * | 7/2014 | Miwa | G03G 21/206 399/111 |
| 2008/0232844 | A1 * | 9/2008 | Taira | G03G 15/326 399/94 |
| 2010/0214390 | A1 * | 8/2010 | Tsujino | B41J 2/451 347/238 |

FOREIGN PATENT DOCUMENTS

| | | | |
|---|---|---|---|
| JP | 2011-16364 | A | 1/2011 |

* cited by examiner

*Primary Examiner* — Joseph S Wong
(74) *Attorney, Agent, or Firm* — Canon U.S.A., Inc. I.P. Division

(57) ABSTRACT

In an image forming apparatus, if a path for transferring heat generated by a drive integrated circuit to a frame (a heat dissipation plate) of an apparatus main body has a point that divides the path, foreign matter such as dirt and dust can be caught at the point, so that heat dissipation efficiency can decrease due to presence of such foreign matter. Therefore, a configuration is provided in which a drive integrated circuit and a frame (a heat dissipation plate) provided in a cover are connected by a heat transfer member, so that a heat transfer path from the drive integrated circuit to the frame has no point that divides the path.

18 Claims, 10 Drawing Sheets

IMAGE FORMING APPARATUS INCLUDING OPTICAL PRINT HEAD

BACKGROUND OF THE INVENTION

Field of the Invention

The present disclosure relates to an image forming apparatus including a cover that opens and closes an opening formed in an apparatus main body, and an optical print head provided in the cover.

Description of the Related Art

An image forming apparatus such as a printer or copier has an optical print head including a plurality of light emitting elements for exposure of a photosensitive drum. As the optical print head, the following types are known. Some types of optical print head each use a light emitting diode (LED) or an organic electro luminescence (EL) element as an example of the light emitting elements, and these light emitting elements are arranged, for example, in one row or in two rows in a staggered configuration, in the rotational axis direction of the photosensitive drum. Further, the optical print head includes a plurality of lenses for condensing light emitted from the plurality of light emitting elements on the photosensitive drum. The plurality of lenses is disposed between the light emitting elements and the photosensitive drum, and is arranged in the direction of the array of the light emitting elements to face the surface of the photosensitive drum. The light emitted from the plurality of light emitting elements is condensed on the surface of the photosensitive drum via the lenses, so that an electrostatic latent image is formed on the photosensitive drum.

Further, as the image forming apparatus including the optical print head, there is one type in which an upper cover can pivot around the apparatus main body and holds the optical print head. An opening is formed on the upper side of the apparatus main body, and the upper cover covers this opening. The upper cover pivots around a rear side portion of the apparatus main body, and the rear side serves as a pivotal axis. The optical print head moves between an exposure position and a retract position interlocking with the pivoting of the upper cover. The photosensitive drum is exposed to the optical print head at the exposure position. At the retract position, the optical print head is retracted from the exposure position and placed away from the photosensitive drum. The optical print head is located at the retract position when the upper cover is opened to make an opening. On the other hand, the optical print head is located at the exposure position when the upper cover is closed to shut the opening. When the upper cover is closed, the optical print head is fixed in position relative to the photosensitive drum. Japanese Patent Application Laid-Open No. 2011-16364 discusses a mechanism for positioning an optical print head relative to a photosensitive drum.

The optical print head discussed in Japanese Patent Application Laid-Open No. 2011-16364 has an upper plate, and a flat spring is provided at the right end (one end in a main-scanning direction) of the upper plate. The flat spring urges the optical print head to pull the right end portion of the optical print head toward a side surface of the apparatus main body. When an operator such as a user or a serviceman closes an upper cover, the flat spring engages with a frame made of metal and forming the side surface of the apparatus main body. The right end portion of the optical print head is thereby pulled toward the frame by the flat spring, so that the position of the optical print head is determined relative to the apparatus main body in the main-scanning direction.

In a case where the image forming apparatus is operated at a high speed, it is necessary to increase a light emission frequency and a light emission amount of the light emitting element per unit time. This can increase the amount of heat generated by a component such as an electronic component included in a circuit board. Therefore, a heat dissipation mechanism for cooling a component such as an electronic component on a circuit board is provided in some cases.

A configuration will be discussed which Japanese Patent Application Laid-Open No. 2011-16364 provides as a heat dissipation mechanism. FIG. 10A illustrates a diagram of a case where the heat dissipation mechanism is provided in the configuration discussed in Japanese Patent Application Laid-Open No. 2011-16364 (a first comparative example). The amount of heat generated by a component such as a drive integrated circuit (IC) 132 increases mainly during image forming operation. Therefore, a configuration is desired which can dissipate the heat generated by an electronic component (such as the drive IC 132) when an optical print head 135 is located at an exposure position. To this end, a flat spring 101 and a component such as the drive IC 132 are connected by, for example, a heat transfer member 130 such as a metal wire, and an adhesive 131 having thermal conductivity, as illustrated in FIG. 10A. The heat generated by the component such as the drive IC 132 spreads to a side frame A1 made of metal and included in the apparatus main body, via the flat spring 101.

FIG. 10A illustrates the heat dissipation mechanism according to the first comparative example. The heat dissipation mechanism according to the first comparative example has a configuration in which the flat spring 101 of the upper cover and the side frame A1 of the apparatus main body are engaged when an operator closes the upper cover. In other words, a transfer path of the heat generated by the electronic component to the side frame A1 has a point (a point where the flat spring 101 of the upper cover contacts the side frame A1 of the apparatus main body) that divides the path on the way. If such a point exists, foreign matter such as dirt and dust can be caught between the flat spring 101 and the side frame A1, so that heat dissipation efficiency decreases.

In view of such a situation, as another example, a configuration of a heat dissipation mechanism according to a second comparative example can be provided as illustrated in FIG. 10B. In this configuration, a drive IC of an upper cover and a side frame of an apparatus main body are connected by a heat transfer member, and a heat transfer path is not divided in opening/closing operation of the upper cover. In this configuration, however, an operator may damage the heat transfer member if he touches the heat transfer member by mistake when performing work for changing a replacement unit.

SUMMARY OF THE INVENTION

According to an aspect of the present disclosure, an image forming apparatus includes an apparatus main body having a photosensitive drum, a cover having a heat dissipation plate, and configured to pivot around the apparatus main body to be movable between a position at which the cover closes an opening formed on a vertical-direction upper side of the apparatus main body and a position at which the cover opens the opening, a circuit board provided with a light emitting element that emits light for exposure of the photosensitive drum, and a drive integrated circuit (IC) that controls a voltage for driving of the light emitting element, a holding member made of resin and holding the circuit board, the holding member being provided in the cover to enable the light emitting element expose the photosensitive drum when the cover is located at the position at which the cover closes the opening, and a heat transfer member made of metal, the heat transfer member being attached to the heat dissipation plate and bonded to the drive IC by an adhesive having thermal conductivity to transfer heat generated by the drive IC in a driving state to the heat dissipation plate.

According to another aspect of the present disclosure, an image forming apparatus includes an apparatus main body having a photosensitive drum, a cover having a heat dissipation plate, and configured to pivot around the apparatus main body to be movable between a position at which the cover closes an opening formed on a vertical-direction upper side of the apparatus main body and a position at which the cover opens the opening, a circuit board provided with a light emitting element that emits light for exposure of the photosensitive drum, and a drive IC that controls a voltage for driving of the light emitting element, a holding member made of resin and holding the circuit board, the holding member being provided in the cover to enable the light emitting element to expose the photosensitive drum when the cover is located at the position at which the cover closes the opening, and a flat spring made of metal, the flat spring being attached to the heat dissipation plate and configured to urge the drive IC toward the circuit board by coming into contact with the drive IC to transfer heat generated by the drive IC in a driving state to the heat dissipation plate.

According to yet another aspect of the present disclosure, an image forming apparatus includes an apparatus main body having a photosensitive drum, a cover having a heat dissipation plate, and configured to pivot around the apparatus main body to be movable between a position at which the cover closes an opening formed on a vertical-direction upper side of the apparatus main body and a position at which the cover opens the opening, a circuit board provided with a light emitting element that emits light for exposure of the photosensitive drum, a drive IC that controls a voltage for driving of the light emitting element, and a connector to which a cable for transmission of an electric signal to each of the light emitting element and the drive IC is to be connected, a holding member made of resin and holding the circuit board, the holding member being provided in the cover to enable the light emitting element expose the photosensitive drum when the cover is located at the position at which the cover closes the opening, a ground terminal formed at a position different from a position at which the drive IC is disposed and a position at which the connector is disposed, on a ground pattern of a circuit pattern of the circuit board, and a heat transfer member made of metal, the heat transfer member being attached to the heat dissipation plate and bonded to the ground terminal by an adhesive having thermal conductivity to thereby transfer heat generated by the ground terminal to the heat dissipation plate.

According to yet another aspect of the present disclosure, an image forming apparatus includes an apparatus main body having a photosensitive drum, a cover having a heat dissipation plate, and configured to pivot around the apparatus main body to be movable between a position at which the cover closes an opening formed on a vertical-direction upper side of the apparatus main body and a position at which the cover opens the opening, a circuit board provided with a light emitting element that emits light for exposure of the photosensitive drum, a drive IC that controls a voltage for driving of the light emitting element, and a connector to which a cable for transmission of an electric signal to each of the light emitting element and the drive IC is to be connected, a holding member made of resin and holding the circuit board, the holding member being provided in the cover to enable the light emitting element to expose the photosensitive drum when the cover is located at the position at which the cover closes the opening, a ground terminal formed at a position different from a position at which the drive IC is disposed and a position at which the connector is disposed, on a ground pattern of a circuit pattern of the circuit board, and a flat spring made of metal, the flat spring being attached to the heat dissipation plate and configured to press the ground terminal by coming into contact with the ground terminal to transfer heat generated by the ground terminal to the heat dissipation plate.

According to yet another aspect of the present disclosure, an image forming apparatus includes an apparatus main body having a photosensitive drum, a cover having a heat dissipation plate, and configured to pivot around the apparatus main body to be movable between a position at which the cover closes an opening formed on a vertical-direction upper side of the apparatus main body and a position at which the cover opens the opening, a circuit board provided with a light emitting element that emits light for exposure of the photosensitive drum, a drive IC that controls a voltage for driving of the light emitting element, and a connector to which a cable for transmission of an electric signal to each of the light emitting element and the drive IC is to be connected, a holding member made of resin and holding the circuit board, the holding member being provided in the cover to enable the light emitting element to expose the photosensitive drum when the cover is located at the position at which the cover closes the opening, a ground terminal formed at a position different from a position at which the drive IC is disposed and a position at which the connector is disposed, on a ground pattern of a circuit pattern of the circuit board, and a heat transfer member made of metal, the heat transfer member being attached to the heat dissipation plate and attached to the ground terminal to transfer heat generated by the ground terminal to the heat dissipation plate.

Further features of the present disclosure will become apparent from the following description of exemplary embodiments with reference to the attached drawings.

DESCRIPTION OF THE EMBODIMENTS

Exemplary embodiments of the present disclosure will be described below with reference to the attached drawings. Components to be described in the exemplary embodiments are merely examples, and the present disclosure is not limited to the exemplary embodiments.

(Overall Configuration of Image Forming Apparatus)

Figure 1A:
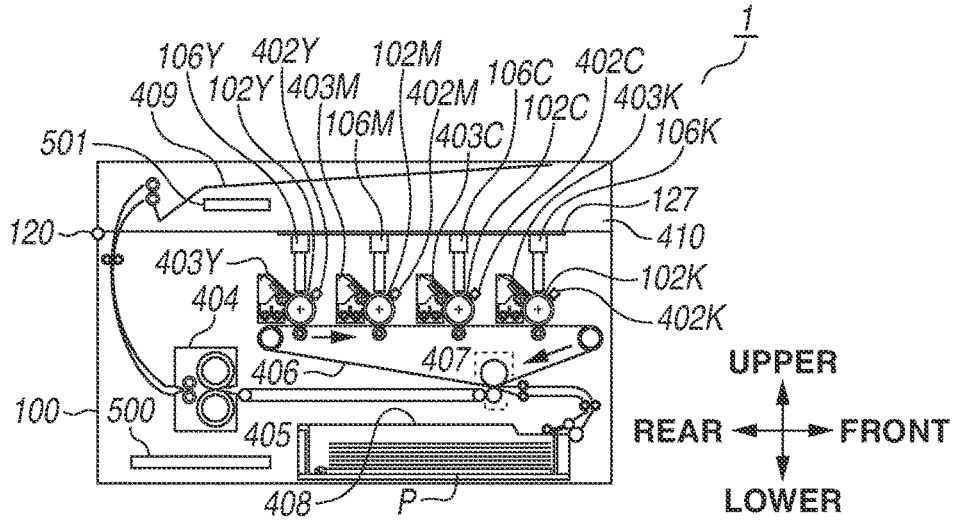
FIGS. 1A, 1B, and 1C are schematic cross-sectional diagrams illustrating an image forming apparatus.
Figure 1B:
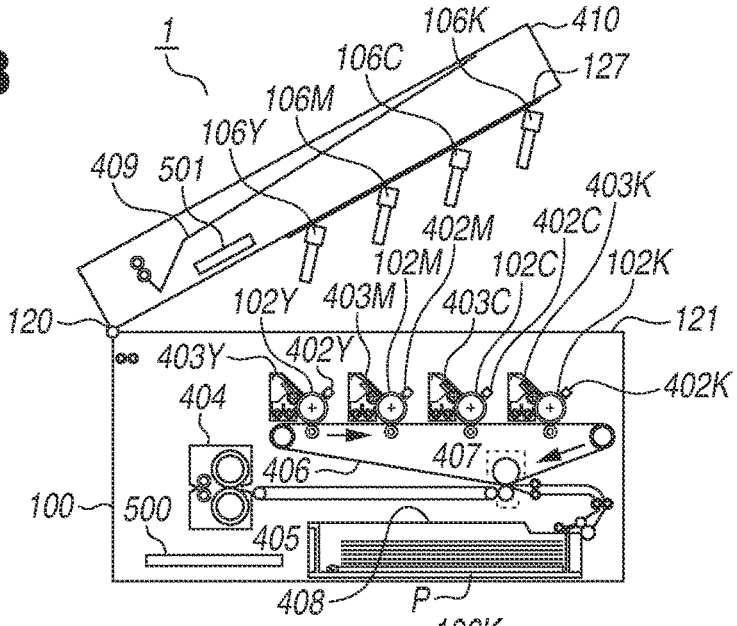
Figure 1C:
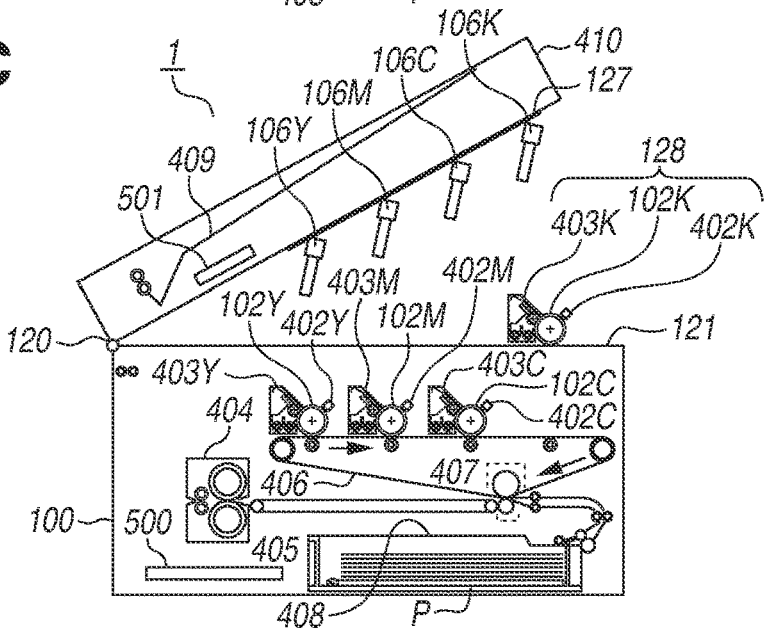

A first exemplary embodiment will be described below. First, a schematic configuration of an image forming apparatus 1 will be described. FIGS. 1A to 1C are schematic cross-sectional diagrams illustrating the image forming apparatus 1. The image forming apparatus 1 illustrated in FIGS. 1A to 1C is a color printer (a single function printer (SFP)) that does not include a reading unit. However, a multifunction apparatus including a reading unit may be utilized in an exemplary embodiment. Further, the image forming apparatus 1 is a color image forming apparatus that employs a tandem system and includes a plurality of photosensitive drums 102 as illustrated in FIGS. 1A to 1C, but exemplary embodiments are not limited to this type of image forming apparatus. For example, a color image forming apparatus including the one photosensitive drum 102 or an image forming apparatus that forms a monochromatic image may be adopted.

The image forming apparatus 1 illustrated in FIGS. 1A to 1C includes photosensitive drums 102Y, 102M, 102C, and 102K corresponding to yellow, magenta, cyan, and black colors, respectively (hereinafter collectively referred to simply as "the photosensitive drum(s) 102"). These photosensitive drums are arranged with a space therebetween.

As illustrated in FIG. 1A, a side where the photosensitive drum 102K corresponding to black color is disposed relative to the photosensitive drum 102Y corresponding to yellow color, is defined as "front side" in the following description. Further, a side where the photosensitive drum 102Y corresponding to yellow color is disposed relative to the photosensitive drum 102K corresponding to black color is defined as "rear side". Furthermore, as illustrated in FIG. 1A, an upper side in FIG. 1A is defined as "vertical-direction upper side", and a lower side in FIG. 1A is defined as "vertical-direction lower side".

The image forming apparatus 1 includes charging devices 402Y, 402M, 402C, and 402K (hereinafter collectively referred to simply as "the charging device(2) 402") that charge the photosensitive drums 102Y, 102M, 102C, and 102K, respectively. The image forming apparatus 1 further includes optical print heads 106Y, 106M, 106C, and 106K (hereinafter collectively referred to simply as "the optical print head(s) 106") serving as exposure light sources that emit light to expose the photosensitive drums 102Y, 102M, 102C, and 102K, respectively. The image forming apparatus 1 illustrated in FIGS. 1A to 1C is an apparatus employing "top surface exposure system" that exposes the photosensitive drum 102 from above in a vertical direction.

Here, one example of an exposure system adopted in an electrophotographic image forming apparatus is a laser beam scanning exposure system. The laser beam scanning exposure system exposes a photosensitive drum through an f-θ lens, by scanning a beam emitted from a semiconductor laser using, for example, a rotating polygon mirror. The "optical print head 106" described in the present exemplary embodiment is used for a light emitting diode (LED) exposure system that exposes the photosensitive drum 102 using light emitting elements such as LEDs that are arranged in a rotational axis direction of the photosensitive drum 102. The optical print head 106 is not used for the laser beam scanning exposure system described above.

Further, the image forming apparatus 1 develops an electrostatic latent image on the photosensitive drum 102, using toner. The image forming apparatus 1 includes development devices 403Y, 403M, 403C, and 403K (hereinafter collectively referred to simply as "the development device(s) 403") that develop toner images of the respective colors on the photosensitive drums 102. Y, M, C, and K attached to the respective numerals represent the respective toner colors.

The image forming apparatus 1 includes an intermediate transfer belt 406 onto which the toner images formed on the respective photosensitive drums 102 are sequentially transferred. The image forming apparatus 1 further includes a secondary transfer roller 407 and a fixing unit 404. The secondary transfer roller 407 transfers the toner images formed on the intermediate transfer belt 406 onto a recording sheet P conveyed from a sheet feeding unit 408. The fixing unit 404 fixes the images transferred by the secondary transfer, on the recording sheet P.

Next, an image forming process will be briefly described by using a process for transferring the toner image of yellow to the intermediate transfer belt 406, as an example. The optical print head 106Y exposes the surface of the photosensitive drum 102Y charged by the charging device 402Y. The electrostatic latent image is thereby formed on the photosensitive drum 102Y. Next, the development device 403Y develops the electrostatic latent image formed on the photosensitive drum 102Y, using the toner of yellow. Afterward, the toner image of yellow developed on the surface of the photosensitive drum 102Y is transferred onto the intermediate transfer belt 406. Each toner image of magenta, cyan, and black is also transferred onto the intermediate transfer belt 406 in a similar image forming process.

The toner image of each color transferred onto the intermediate transfer belt 406 is transferred onto the recording sheet P conveyed from the sheet feeding unit 408, with a transfer bias of the secondary transfer roller 407.

The fixing unit 404 fixes the toner images on the recording sheet P by heat and pressure. After undergoing the fixing process, the recording sheet P is ejected to a sheet discharge unit 409 by the fixing unit 404.

The image forming apparatus 1 includes an apparatus main body 100 and a cover 410. The cover 410 has a frame (an example of a heat dissipation plate) 127 made of metal, in a part of the cover 410 to increase the strength. The cover 410 may be configured of one metal plate to increase the strength. The cover 410 is configured of one metal plate, and is mounted on the apparatus main body 100. The cover 410 pivots around the apparatus main body 100. FIG. 1A illustrates the image forming apparatus 1 in a state where the cover 410 is closed, and FIG. 1B illustrates the image forming apparatus 1 in a state where the cover 410 is opened. As illustrated in FIG. 1B, an opening 121 is formed on a vertical-direction upper side of the apparatus main body 100. In other words, the opening 121 is shut by the cover 410 when the cover 410 is closed, and the opening 121 is made when the cover 410 is opened.

Here, the cover 410 illustrated in FIGS. 1A to 1C pivots about a pivot shaft 120, which extends in a direction of the rotational axis of the photosensitive drum 102. In other words, the direction of the pivotal axis of the cover 410 and the direction of the rotational axis of the photosensitive drum 102 coincide with each other. However, the pivot direction of the cover 410 is not limited to the direction illustrated in FIGS. 1A to 1C, and the pivot shaft 120 may extend in a direction orthogonal to the direction of the rotational axis of the photosensitive drum 102. The cover 410 is thereby movable between a position at which the cover 410 is opened to open the opening 121 and a position at which the cover 410 is closed to close the opening 121, by pivoting about the pivot shaft 120.

Further, FIG. 1C is a diagram illustrating how a replacement unit 128 is attached to and detached from the apparatus main body 100 via the opening 121, in the state where the cover 410 is opened. As illustrated in FIG. 1C, the replacement unit 128 is a replaceable cartridge formed by integrating the photosensitive drum 102, the charging device 402, and the development device 403. The replacement unit 128 is regularly replaced by an operator such as a user or a serviceman. The "replacement unit 128" described here needs to only include at least the photosensitive drum 102. The photosensitive drum 102 is pivotally supported with respect to a frame of the replacement unit 128.

(Configuration of Optical Print Head)

Next, a positional relationship between the photosensitive drum 102 and the optical print head 106 will be described.

Figure 2A:
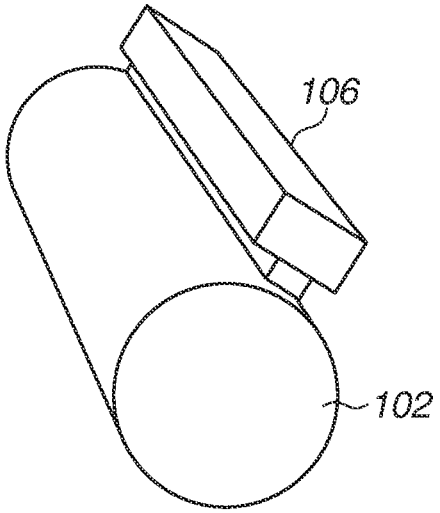
FIGS. 2A and 2B are schematic diagrams illustrating an optical print head and a photosensitive drum.

FIG. 2A is a diagram illustrating how the optical print head 106 is disposed relative to the photosensitive drum 102 when the cover 410 is closed. When the cover 410 is closed, the optical print head 106 faces the photosensitive drum 102 as illustrated in FIG. 2A. The optical print head 106 then exposes the photosensitive drum 102 from the vertical-direction upper side of the photosensitive drum 102.

Figure 2B:
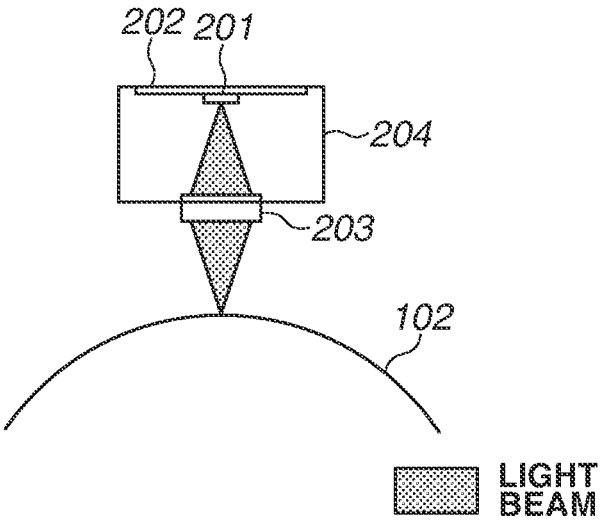

FIG. 2B is a diagram illustrating a path of light emitted from the optical print head 106. The optical print head 106 includes a housing 204 (a holding member), a circuit board 202, and a rod lens array 203. The housing 204 holds the circuit board 202 and the rod lens array 203. In the present exemplary embodiment, the housing 204 is a molded object made of resin and formed by injection molding. However, the housing 204 may be a metal frame having a portion to which a member made of resin is attached. As will be described in detail below, a plurality of LED chips 201 is mounted on the circuit board 202. The LED chip 201 includes a plurality of LEDs serving as a light emitting element 126. Light emitted from these light emitting elements 126 is condensed on the surface of the photosensitive drum 102 via the rod lens array 203.

Figure 3A:
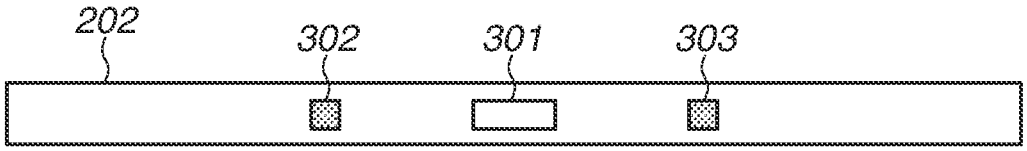
FIGS. 3A, 3B, and 3C are diagrams illustrating a circuit board and a light emitting diode (LED) chip of the optical print head.
Figure 3B:
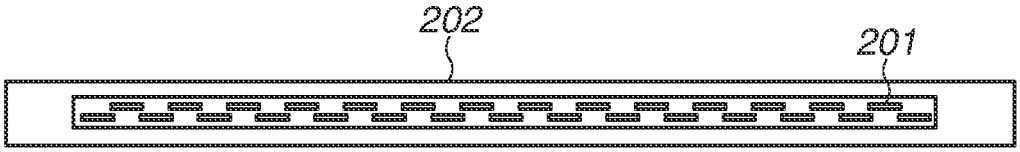
Figure 3C:
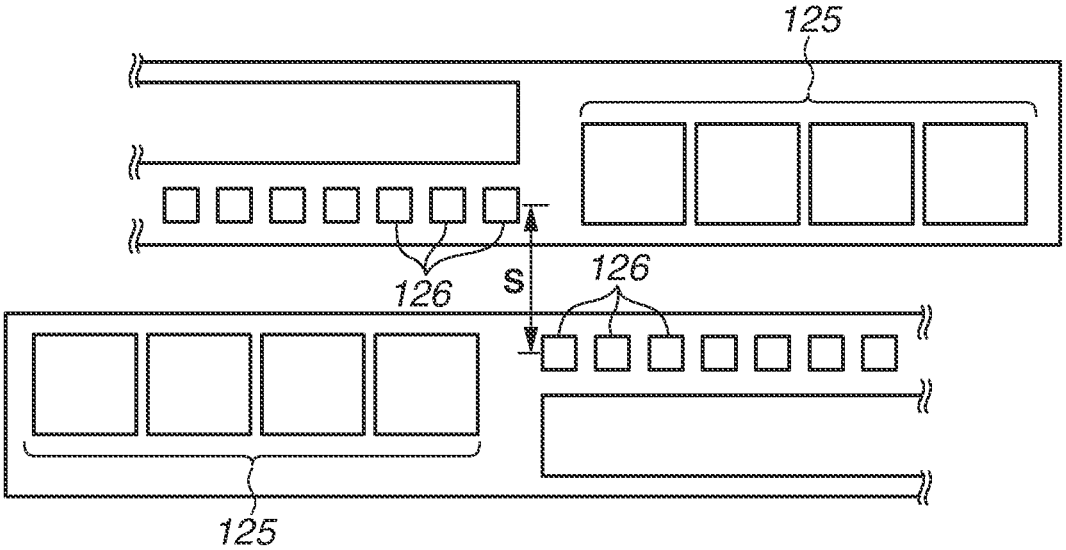

Next, a configuration of the circuit board 202 will be described in detail. FIGS. 3A to 3C each illustrate an enlarged view of the circuit board 202. FIG. 3B illustrates a surface (hereinafter referred to as the mounting surface) on which the LED chips 201 are mounted. FIG. 3A illustrates a surface (hereinafter referred to as the non-mounting surface) opposite to the surface on which the LED chips 201 are mounted. As illustrated in FIG. 3B, 29 pieces of the LED chips 201 are arranged in a staggered configuration on the mounting surface. In each of the LED chips 201, 512 pieces of the light emitting elements 126 are arranged with a predetermined resolution pitch in the lengthwise direction of the chip 201. The resolution of the image forming apparatus 1 according to the present exemplary embodiment is 1200 dpi. Therefore, the light emitting elements 126 are arranged in a line in the lengthwise direction of the LED chip 201 in such a manner that the distance between the centers of the respective light emitting elements 126 adjacent to each other is 21.16 μm. Within each of the LED chips 201, the distance from one end to the other end of the array of the light emitting elements 126 is about 10.8 mm. Because the twenty-nine LED chips 201 are arranged, the number of the light emitting elements 126 that can perform exposure is 14,848. This enables image formation adaptable to an image of about 314 mm width.

FIG. 3C illustrates a state of the boundary between the LED chips 201. A wire bonding pad 125 for inputting a control signal is disposed at an end of the LED chip 201. A signal for controlling light emission timing of the light emitting element 126 is input from the wire bonding pad 125 to the LED chip 201. The pitch in the lengthwise direction of the light emitting element 126 is 21.16 μm also in the boundary between the LED chips 201. Further, the LED chips 201 are arranged such that a distance (a distance S in FIG. 3C) between the light emission points of the respective LED chips 201 in two lines is about 84 μm (for four pixels at 1200 dpi, and for eight pixels at 2400 dpi). A drive voltage control element 302 (an example of a drive IC), a connector 301, and a storage element 303 (an example of the drive IC) are disposed on the non-mounting surface of the circuit board 202. The drive voltage control element 302 controls a voltage for driving the LED chip 201. The storage element 303 temporarily stores information of a signal for driving the LED chip 201.

A signal line, a power source, and a ground line are connected from a main body circuit board 500 to the connector 301. The signal line is provided to control the drive voltage control element 302 and the storage element 303. A wiring line extending from the drive voltage control element 302 to drive the LED chip 201 is connected to each of the LED chips 201 through an inner layer of the circuit board 202.

(Control Blocks)

Figure 4:
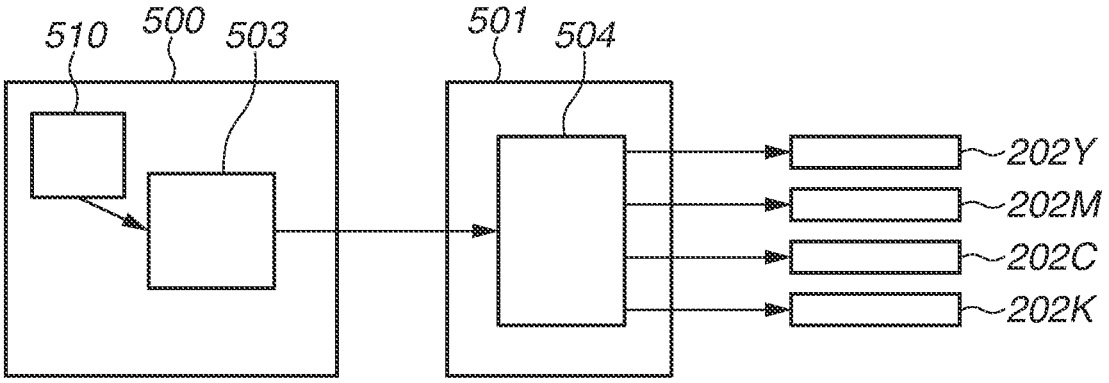
FIG. 4 is a diagram illustrating control blocks.

FIG. 4 illustrates a control block diagram. A circuit board configuration for controlling the optical print head 106 in the present exemplary embodiment includes the main body circuit board 500, an LED control circuit board 501, and the circuit board 202 mounted with the LED chips 201.

The main body circuit board 500 is a circuit board for controlling each part of the main body during image formation. The main body circuit board 500 includes a main central processing unit (CPU) 510, and the main CPU 510 controls each part of the main body. The main body circuit board 500 further includes an image control unit 503 that performs image processing. Upon receiving an instruction for image formation from the main CPU 510, the image control unit 503 outputs image data for the image formation to an LED light emission control unit 504. This image data includes a plurality of pieces of unit image data corresponding to the plurality of light emitting elements 126 included in the LED chip 201. The image control unit 503 outputs the image data in a predetermined sequence, to the LED light emission control unit 504. The LED light emission control unit 504 generates irradiation data, using the image data output from the image control unit 503. The image data from the image control unit 503 includes color information indicating each color. The LED light emission control unit 504 transmits the irradiation data corresponding to each color to the corresponding circuit boards 202Y, 202M, 202C, and 202K, based on this color information. Based on the irradiation data transmitted to the circuit board 202, the light emitting element 126 is turned on to irradiate the photosensitive drum 102 with light.

(Heat Dissipation Mechanism)

Next, a configuration for dissipating the heat generated by the drive voltage control element 302 (an example of the drive IC) mounted on the circuit board 202 will be described.

In general, when the operation of an image forming apparatus is accelerated, a heavy current is necessary for driving of a light emitting element included in an optical print head. When an electric current flowing through a circuit pattern formed on a circuit board increases, the amount of heat generated by a drive IC also increases. The "drive IC" mentioned here indicates, for example, an application-specific integrated circuit (ASIC) element manufactured for a specific use, and a regulator for converting a voltage. In the present exemplary embodiment, the drive IC indicates the drive voltage control element 302 and the storage element 303.

An increase in the amount of heat generated by the drive IC can cause abnormal operation of the drive IC in itself. In addition, the package life of the drive IC can be reduced by abnormal thermal expansion or thermal contraction. The increase in the amount of heat generated by the drive IC can adversely affect members around the drive IC. For example, the housing 204 can be deformed by the heat generated by the drive IC. Even if the circuit board 202 is a board having thermal conductivity, e.g., a silicon substrate (thermal conductivity: about 150 W/mk), the heat escaping from the drive IC to the circuit board 202 fills the housing 204 and thereby deforms the housing 204. If the circuit board 202 or the rod lens array 203 deforms due to the deformation of the housing 204, an image defect can occur. To avoid such a trouble, in one type of image forming apparatus, in a case where a drive IC is heated up to a certain level, image forming operation is suspended until the temperature of the drive IC drops. Accordingly, the rise in the temperature of the drive IC is one of the causes of productivity decline of the image forming apparatus. Therefore, it is necessary to work out a way of efficiently dissipating the heat generated by the drive IC.

Figure 10A:
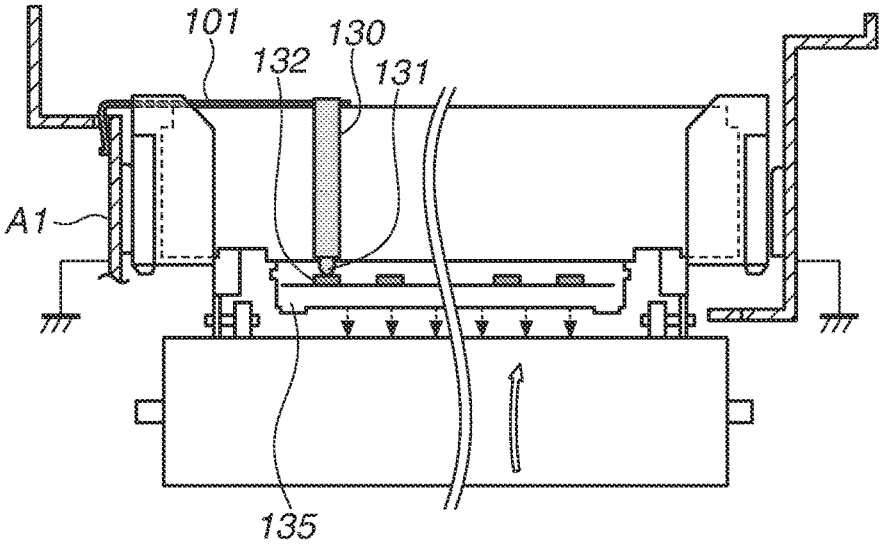
FIG.10A PRIOR ART
FIGS. 10A and 10B are diagrams each illustrating a heat dissipation mechanism according to a comparative example.
Figure 10B:
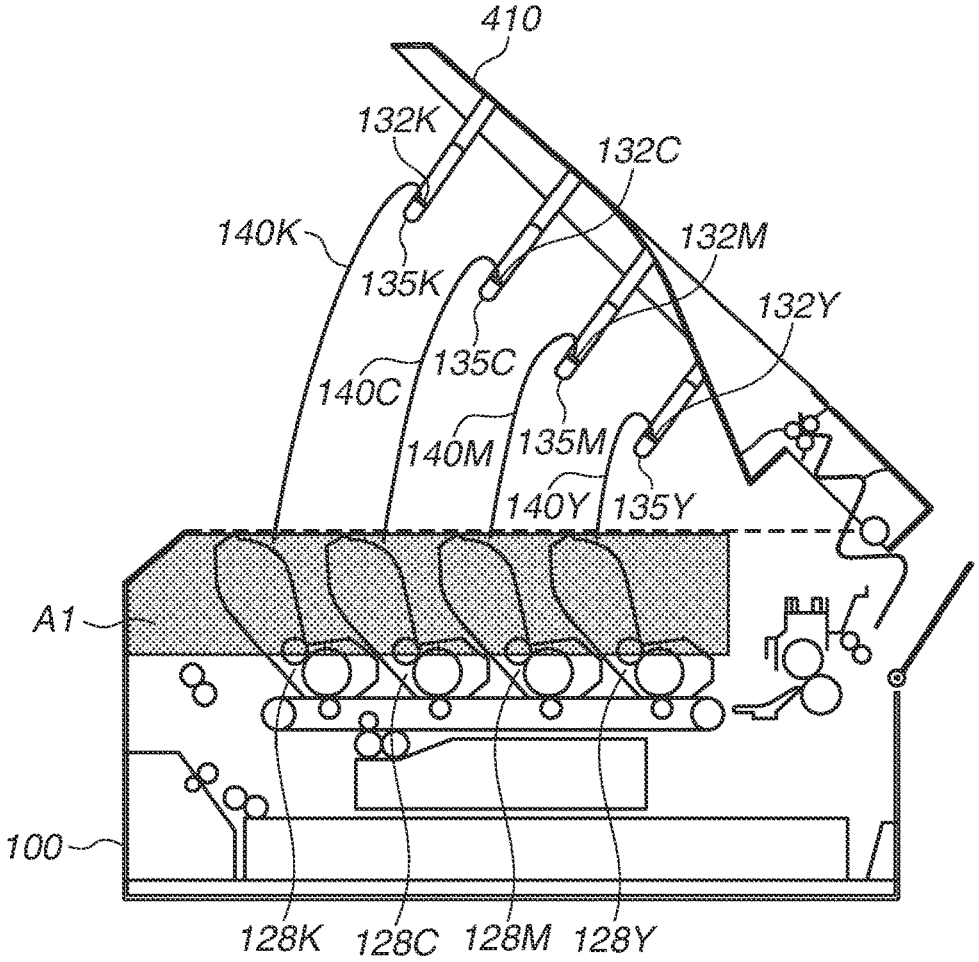
FIG.10B PRIOR ART

FIGS. 10A and 10B are diagrams illustrating a comparative example for explaining an advantage of the heat dissipation mechanism of the present exemplary embodiment. As with the image forming apparatus 1 described in the present exemplary embodiment, an optical print head 135 is provided in a cover that opens and closes relative to an apparatus main body. In a configuration of a heat dissipation mechanism illustrated in FIG. 10A, the heat generated by a drive IC 132 on a circuit board provided in the optical print head 135 is transferred to a side frame A1 made of metal and included in the apparatus main body. As illustrated in FIG. 10A, a flat spring 101 and a component such as the drive IC 132 are connected by, for example, a heat transfer member 130 such as a metal wire, and an adhesive 131 having thermal conductivity. The heat generated by the component such as the drive IC 132 thereby disperses to the side frame A1 made of metal and included in the apparatus main body, via the flat spring 101.

In this configuration, however, the flat spring 101 and the side frame A1 are disengaged from each other when the cover is opened relative to the apparatus main body. In other words, a heat transfer path from the drive IC 132 to the side frame A1 is divided by the opening/closing of the cover. In such a configuration, foreign matter such as dirt and dust can adhere to a contact portion between the flat spring 101 and the side frame A1, in a state where the cover is opened. A possibility cannot be ignored that heat transfer efficiency decreases due to the presence of dirt and dust on the heat transfer path. Therefore, a configuration is desired that prevents dirt and dust from entering the heat transfer path even if the opening/closing operation of the cover is performed.

FIG. 10B is a diagram illustrating a mechanism in which a heat transfer member 140 is directly connected to the drive IC 132 and the side frame A1, in order to prevent entrance of dirt and dust into the heat transfer path due to the opening/closing operation of the cover. In this mechanism, because the heat transfer path is not divided even if an operator opens and closes the cover, dirt and dust do not enter the heat transfer path. However, a hand or arm of the operator can damage the heat transfer member 140 by touching the heat transfer member 140 during replacement work for a replacement unit 128 or clearing of the optical print head 135. Therefore, it is hard to say that the mechanism illustrated in FIG. 10B is a satisfactory configuration in terms of handling and maintaining.

Figure 5:
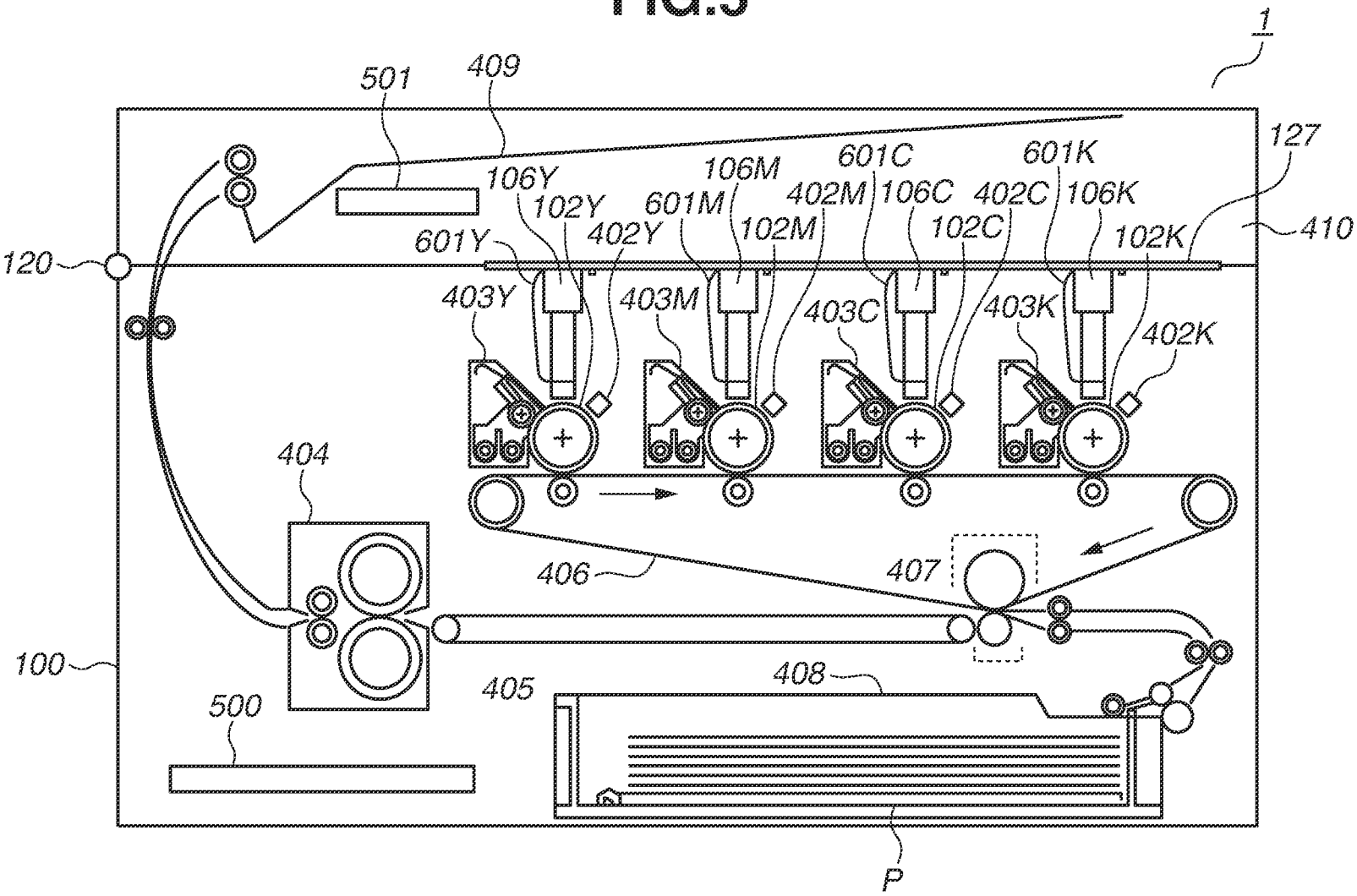
FIG. 5 is a diagram illustrating a heat transfer member.
Figure 6A:
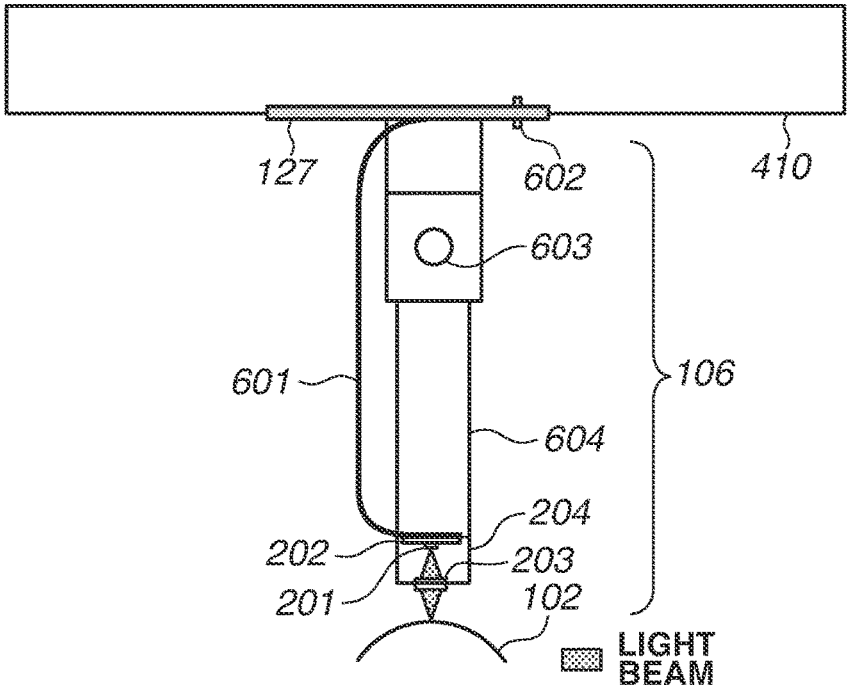
FIGS. 6A and 6B are diagrams illustrating the image forming apparatus in a cover open state.
Figure 6B:
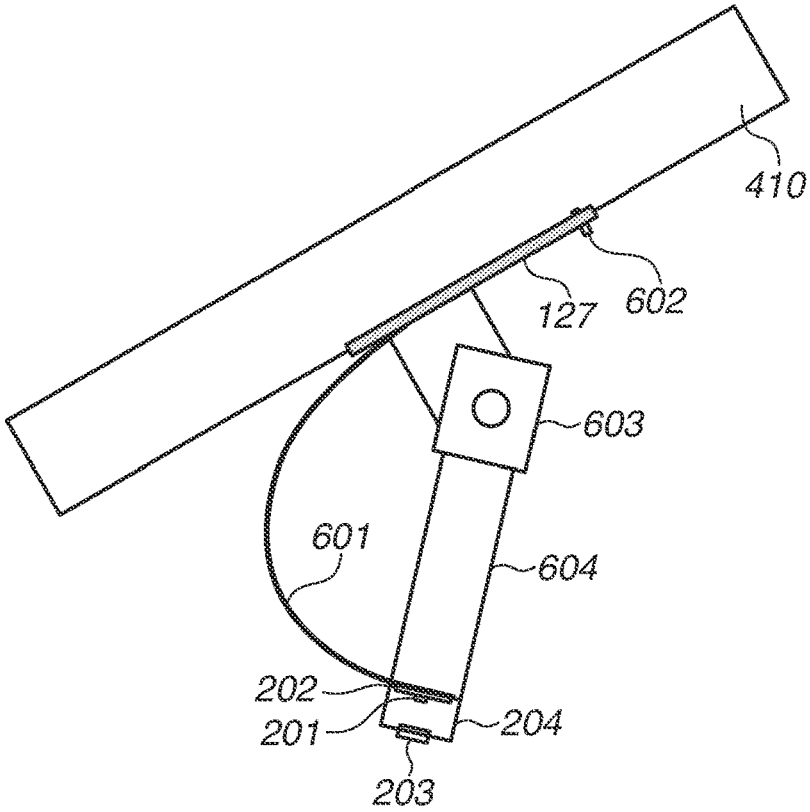

FIGS. 5, 6A, and 6B are diagrams for illustrating a heat transfer member 601 that are connected to the cover 410 and the optical print head 106. As illustrated in FIG. 5, the optical print heads 106Y, 106M, 106C, and 106K are provided with heat transfer members 601Y, 601M, 601C, and 601K (hereinafter collectively referred to simply as "the heat transfer member(s) 601), respectively. The heat transfer member 601 is a member independent of the housing 204. Further, as illustrated in FIG. 6A, the heat transfer member 601 is connected to the circuit board 202 and the cover 410. In the present exemplary embodiment, the heat transfer member 601 is a flat spring made of metal. The heat transfer member 601 is made of, for example, an aluminum plate having a thickness of 0.5 mm. Thermal conductivity of aluminum is about 230 W/mk, and this thermal conductivity is higher than the thermal conductivity of the circuit board 202. The material of the heat transfer member 601 is not limited to aluminum. Any kind of metal is suitable if the metal has thermal conductivity of 10.0 W/mk or more, and a material such as stainless steel copper (thermal conductivity: 16.7 W/mk) may be used. It is not necessarily required to form the heat transfer member 601 as a single piece, and the heat transfer member 601 may be configured by combining a plurality of members. Even if the heat transfer member 601 is configured of a plurality of different members made of metal, such plurality of members is assembled to each other and thereby integrated. Therefore, separation of the plurality of members does not occur when the operator opens and closes the cover 410.

As described above, the cover 410 has the frame 127 made of metal in order to increase the strength. The heat transfer member 601 is connected to the part of the frame 127 made of metal in the cover 410. Accordingly, the heat generated by the drive IC on the circuit board 202 is dispersed to the frame 127 made of metal via the heat transfer member 601. Thus, the frame 127 also serves as a heat dissipation plate. The frame 127 made of metal is, for example, a metal plate made of aluminum and having a thickness of 1.0 mm, and has a rectangular shape (having a long side of 350 mm, and a short side of 250 mm) extending in the lengthwise direction of the optical print head 106. Thus, the frame 127 is a metal plate whose area is sufficiently large as compared with the drive IC. In the present exemplary embodiment, the frame 127 is one metal plate, and the heat transfer members 601Y, 601M, 601C, and 601K corresponding to the optical print heads 106Y, 106M, 106C, and 106K, are connected to the frame 127. The heat transfer member 601 and the frame 127 are fixed by, for example, a fixing member 602 such as a screw. It is desirable that the fixing member 602 be made of metal in order to increase the heat dissipation efficiency further.

In the comparative example illustrated in FIG. 10A, the heat transfer member 130 and the side frame A1 are connected by the flat spring 101. In contrast, in the present exemplary embodiment, the heat transfer member 601 is connected to the frame 127 made of metal and included in the cover 410. As illustrated in FIG. 5, the distance between the optical print head 106 and the frame 127 is very short and is about 80 mm. Therefore, the heat transfer path from the drive IC to the frame 127 can be shorter than the heat transfer path in the configuration of the comparative example.

The heat transfer member 601 does not need to be connected to the frame 127 for increasing the strength of the cover 410, or may be connected to a different metal plate. In other words, the heat transfer member 601 may be connected to a metal plate attached to the cover 410 for the purpose of heat dissipation. In this case, the metal plate to which the heat transfer member 601 is connected is equivalent to the frame 127, and serves as a heat dissipation plate.

Further, the cover 410 is provided with a support member 604 having the optical print head 106. The support member 604 is provided pivotally about a pivot shaft 603 around the cover 410. The support member 604 supports the housing 204 that holds the circuit board 202 and the rod lens array 203. The heat transfer member 601 and the support member 604 are members independent of each other, and thus each can move independently. More specifically, the heat transfer member 601 does not interfere with movement such as pivoting of the support member 604. The cover 410 and the support member 604 as combined may be referred to as the cover 410. The support member 604 may have the frame 127 serving as a heat dissipation plate. In such an example, the support member 604 is provided with the frame 127 that is a rectangular heat dissipation plate, and the heat transfer member 601 is attached to the frame 127.

Further, here, an example is illustrated in which the support member 604 includes the housing 204. Instead, the frame 127 may be configured to support the housing 204. Also in this case, the frame 127 and the support member 604 may be assumed to be a part of the cover 410. In a configuration in which the frame 127 supports the support member 604, it is desirable that the housing 204 be made of resin while the frame 127 is made of metal. Because the housing 204 pivots around the frame 127, if both are made of metal, rubbing noise can be produced at a contact portion between these members and thereby annoy the user. Further, it is not necessarily required to form the support member 604 as a single piece, and the support member 604 may be configured by combining a plurality of members.

FIG. 6B is a diagram illustrating how the cover 410 pivots around the apparatus main body 100. When the support member 604 pivots around the cover 410, the heat transfer member 601 bends in response to this pivoting. In this way, the heat transfer member 601 can flexibly bend and thus, the heat transfer member 601 does not interfere with the pivoting of the support member 604 around the cover 410. When the cover 410 enters a closing from an open state, the support member 604 and the optical print head 106 come to a predetermined position.

Figure 7A:
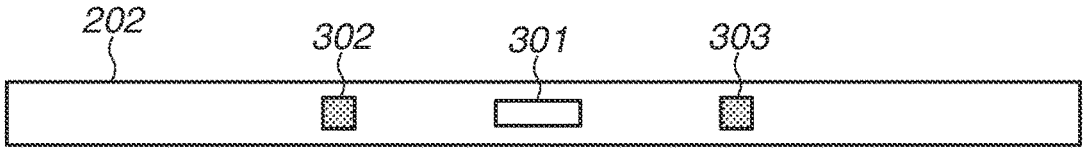
FIGS. 7A to 7D are diagrams illustrating a path for transferring heat generated by a heat generator.

FIG. 7A is a diagram illustrating the non-mounting surface of the circuit board 202. As illustrated in FIG. 7A, the circuit board 202 includes the drive voltage control element 302 (an example of the drive IC) that controls a voltage for driving the light emitting element 126, and the storage element 303 (an example of the drive IC). Further, the connector 301 is provided at a central part of the circuit board 202. A flexible flat cable (an example of a cable) for transmitting electric signals to these drive ICs and the light emitting element 126 is connected to the connector 301. A circuit pattern is formed on the circuit board 202, and an electric current flows through this circuit pattern.

Figure 7B:
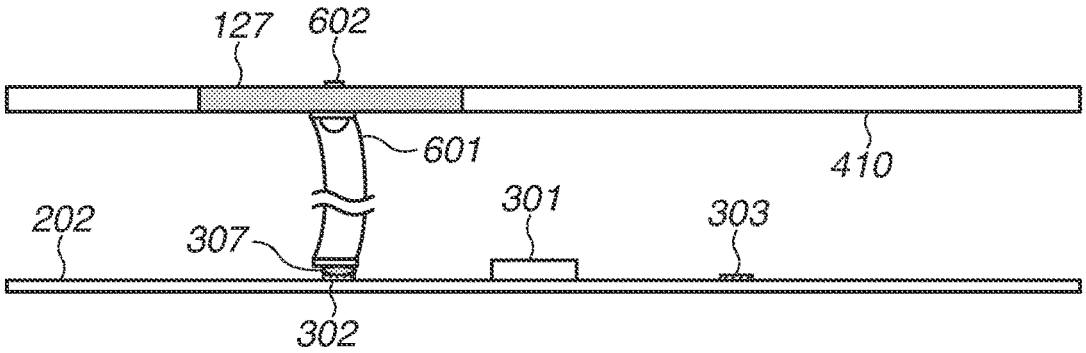
Figure 7C:
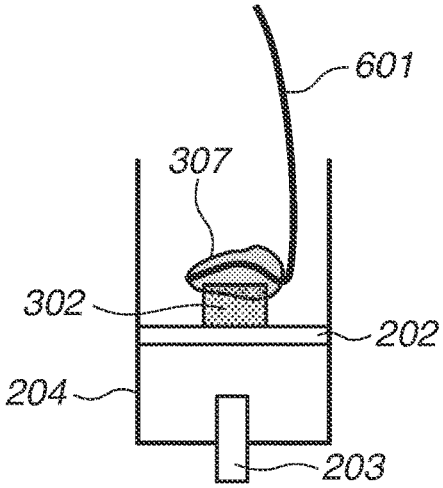

FIGS. 7B and 7C are diagrams illustrating a state where the heat transfer member 601 and the drive voltage control element 302 (an example of the drive IC) are bonded by an adhesive 307 having thermal conductivity. FIG. 7C is a schematic diagram illustrating a cross-section of the housing 204 mounted with the circuit board 202, when the cross-section is taken in a direction perpendicular to the lengthwise direction of the housing 204. The "adhesive 307 having thermal conductivity" described here includes the adhesive having thermal conductivity of 0.5 W/mk or more. This "adhesive 307 having thermal conductivity" may be typically referred to as "heat dissipation grease" or "heat dissipation adhesive", and silicon is often used as a material thereof. The adhesive 307 in the present exemplary embodiment is an adhesive made of silicon and having thermal conductivity of 0.71 W/mk. In the present exemplary embodiment, the heat transfer member 601 is connected to the drive voltage control element 302, but the heat transfer member 601 may be connected to the storage element 303 by the adhesive 307.

The drive ICs such as the drive voltage control element 302 and the storage element 303 can have a concave-convex shape on the surface. If the adhesive 307 is used, the adhesive 307 adheres to the element surface having the concave-convex shape. Therefore, the heat generated by the elements can be efficiently transferred to the heat transfer member 601.

Further, a double-sided tape having thermal conductivity of 0.5 W/mk or more may be used for adhesion between the drive voltage control element 302 and the heat transfer member 601. The double-sided tape in this case is made of, for example, a composite material including metal foil and polymer material. Therefore, the double-sided tape adheres to the element to fill in the unevenness of the element surface. This increases an area contacting the element, and thereby increases the heat dissipation efficiency.

In the present exemplary embodiment, the thermal conductivity of the heat transfer member 601 is higher than the thermal conductivity of the adhesive 307. However, the relationship between the thermal conductivities of both members is not limited to the above-described case, and the thermal conductivity of the adhesive 307 may be higher than the thermal conductivity of the heat transfer member 601.

Figure 7D:
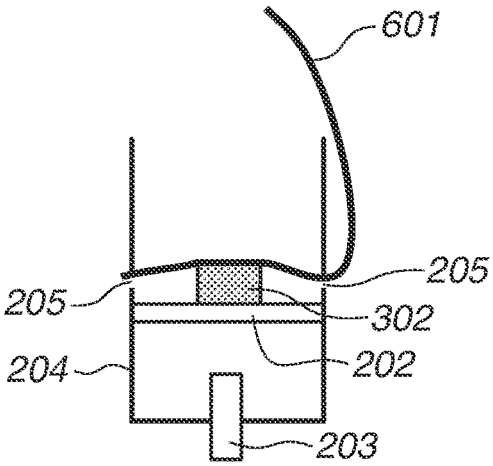

FIG. 7D illustrates a mechanism that uses a flat spring for the heat transfer member 601. As illustrated in FIG. 7D, the heat transfer member 601 passes through an opening 205 formed in the housing 204. The opening 205 penetrates the housing 204 in a direction perpendicular to the lengthwise direction of the housing 204. The position at which the opening 205 is formed is slightly lower than the top surface of the drive voltage control element 302 (the upper side in a paper plane of FIG. 7D) of the circuit board 202 mounted on the housing 204. As a consequence, the heat transfer member 601 passing through the opening 205 of the housing 204 comes into contact with the drive voltage control element 302 to bend protruding upward. As a result, the heat transfer member 601 presses the drive voltage control element 302 in a state where the heat transfer member 601 is in contact with the drive voltage control element 302. In other words, the heat transfer member 601 urges the drive voltage control element 302 toward the circuit board 202. This maintains a state where the heat transfer member 601 and the drive voltage control element 302 are reliably in contact with each other.

Thus, the heat generated by the drive ICs such as the drive voltage control element 302 and the storage element 303 is transferred to the heat transfer member 601. The heat transferred to the heat transfer member 601 is further transferred to the frame 127 made of metal that is included in the cover 410. A rise in the temperature of the drive voltage control element 302 and the storage element 303 is thus suppressed.

Figure 8A:
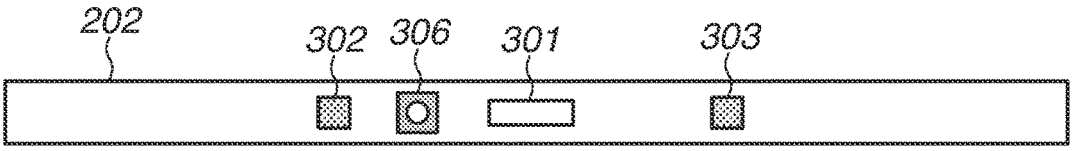
FIGS. 8A to 8D are diagrams illustrating a path for transferring heat generated by a heat generator according to a second exemplary embodiment.

A second exemplary embodiment will be described below. FIG. 8A is a diagram illustrating a circuit board 202 of the second exemplary embodiment. A circuit pattern formed on the circuit board 202 of the second exemplary embodiment has a ground pattern having a ground potential. A GND pad 306 (a ground terminal) is provided on the ground pattern. In other words, the GND pad 306 and the ground pattern are electrically connected. A region where the ground pattern is exposed in the circuit board 202 may also be referred to as the GND pad 306. The GND pad 306 is provided on the ground pattern, at a position different from where drive ICs such as a drive voltage control element 302, and a storage element 303 are disposed and different from where a connector 301 is disposed.

Figure 8B:
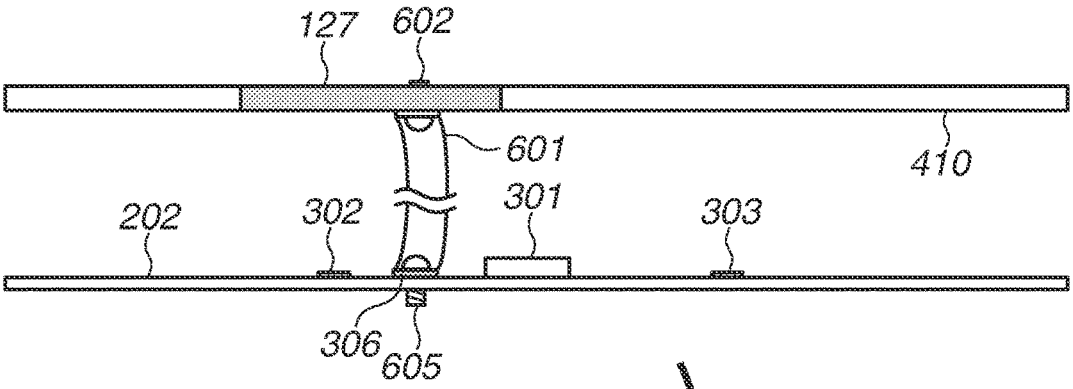

In the present exemplary embodiment, the GND pad 306 is a square 10 mm on a side, and a through-hole penetrating the circuit board 202 is formed at the center of the GND pad 306. FIG. 8B is a diagram illustrating a state where the GND pad 306 and a heat transfer member 601 are fixed by a fixing member 605. The fixing member 605 is a metal screw. With this configuration, the heat transfer member 601 can be reliably brought into contact with the GND pad 306. Heat generated by the GND pad 306 is transferred to a frame 127 made of metal and included in a cover 410, via the heat transfer member 601.

Typically, heat generated by each of the drive ICs such as the drive voltage control element 302 and the storage element 303 dissipates in the air, via the circuit pattern formed on the circuit board 202. Therefore, the heat generated by each of the drive ICs is transferred to the heat transfer member 601, by bringing the GND pad 306 into contact with the heat transfer member 601.

Figure 8C:
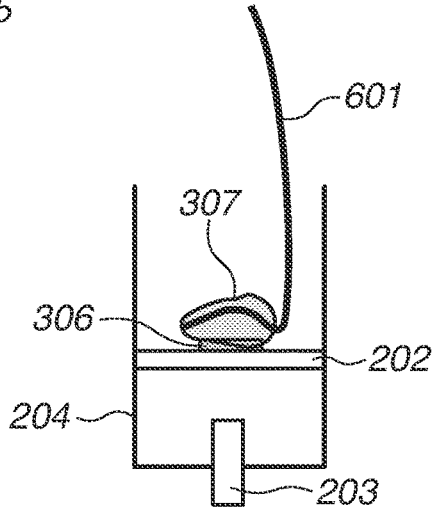

FIG. 8C is a diagram illustrating a state where the heat transfer member 601 and the GND pad 306 are bonded by an adhesive 307 having thermal conductivity. FIG. 8C is a schematic diagram illustrating a cross-section of a housing 204 mounted with the circuit board 202, when the cross-section is taken along a direction perpendicular to the lengthwise direction of the housing 204. As illustrated in FIG. 8C, it is acceptable to bond the heat transfer member 601 and the GND pad 306 using the adhesive 307, without forming a screw hole (a through-hole) in the GND pad 306.

Figure 8D:
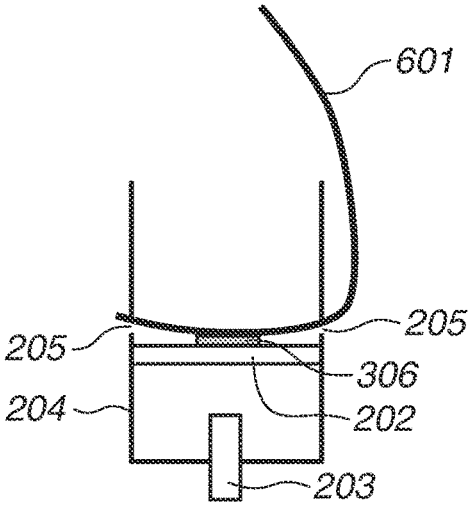

FIG. 8D illustrates a mechanism using a flat spring for the heat transfer member 601. As illustrated in FIG. 8D, the heat transfer member 601 passes through an opening 205 formed in the housing 204. The opening 205 penetrates the housing 204 in a direction perpendicular to the lengthwise direction of the housing 204.

Here, as illustrated in FIG. 8D, the heat transfer member 601 slightly bends to protrude toward the circuit board 202 (toward the lower side in FIG. 8D). The heat transfer member 601 passing through the opening 205 of the housing 204 thereby presses the GND pad 306. The heat generated by the GND pad 306 is transferred to the frame 127 made of metal and included in the cover 410, via the heat transfer member 601.

Figure 9A:
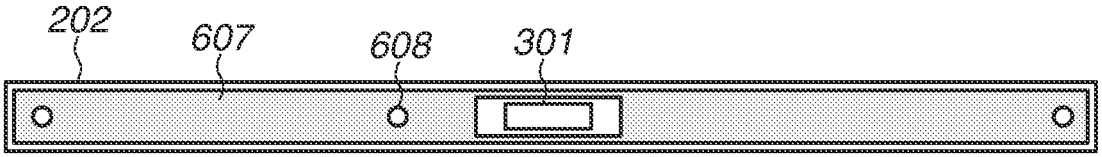
FIGS. 9A and 9B are diagrams illustrating a path for transferring heat generated by a heat generator according to a third exemplary embodiment.

A third exemplary embodiment will be described below. A heat dissipation mechanism of the third exemplary embodiment will be described with reference to FIGS. 9A and 9B. FIG. 9A is a diagram illustrating a metal plate 607 attached to a housing 204 made of resin. For example, the metal plate 607 is a plate made of metal such as aluminum. The metal plate 607 is attached to a circuit board 202 to face the non-mounting surface of the circuit board 202. A screw hole is formed at each of both ends of the circuit board 202 in the lengthwise direction of the circuit board 202. The metal plate 607 is fixed by a screw inserted into the screw hole.

Figure 9B:
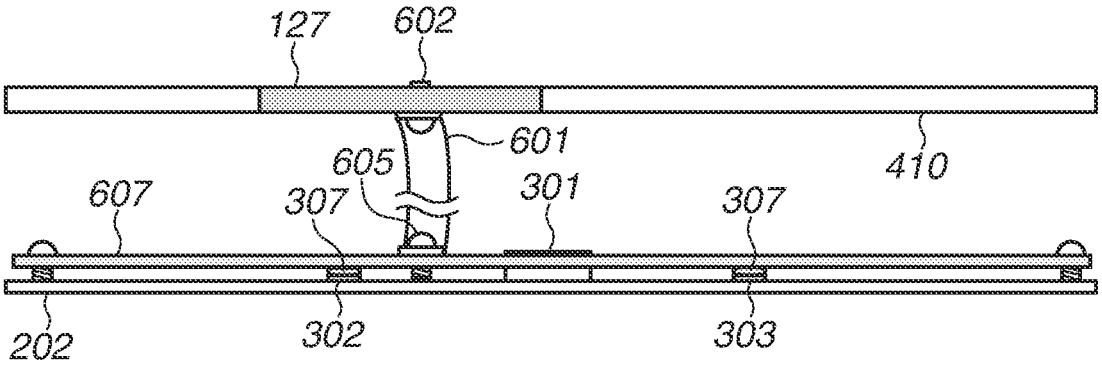

FIG. 9B is a diagram illustrating a state where the metal plate 607 is fixed to the circuit board 202. A space of, for example, about 10 mm is formed between the metal plate 607 and the circuit board 202. An adhesive 307 is applied to each of a drive voltage control element 302 and a storage element 303. The metal plate 607 is fixed to the circuit board 202 to be in contact with these adhesives 307. It is not necessarily required to fix the metal plate 607 to the circuit board 202. For example, the metal plate 607 may be fixed to the housing 204 made of resin. A heat transfer member 601 and the metal plate 607 combined may be referred to as "heat transfer member".

Heat generated by drive ICs such as the drive voltage control element 302 and the storage element 303 is transferred to the metal plate 607 via the adhesive 307. The heat transferred to the metal plate 607 is further transferred to a frame 127 made of metal and included in a cover 410, via the heat transfer member 601.

In the third exemplary embodiment, because the metal plate 607 is provided, an effect of improvement in removing the heat from the drive IC can be expected as compared with a conventional mechanism, even if the heat transfer member 601 is not provided. However, as described above, the distance between the metal plate 607 and the circuit board 202 is only about 10 mm. It is therefore possible that the housing 204 made of resin deforms due to a rise in temperature of the metal plate 607 itself. Hence, dispersing the heat retained by the metal plate 607 to the frame 127 via the heat transfer member 601 as shown in the present exemplary embodiment is an effective way of preventing inconvenience such as an image formation defect.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-121705, filed Jun. 27, 2018, which is hereby incorporated by reference herein in its entirety.

What is claimed is:

1. An image forming apparatus comprising:

an apparatus main body having a photosensitive drum;

a cover having a heat dissipation plate, and configured to pivot around the apparatus main body to be movable between a position at which the cover closes an opening formed on a vertical-direction upper side of the apparatus main body and a position at which the cover opens the opening;

a circuit board provided with a light emitting element that emits light for exposure of the photosensitive drum, and a drive integrated circuit that controls a voltage for driving of the light emitting element;

a holding member made of resin and holding the circuit board, the holding member being provided in the cover to enable exposure of the photosensitive drum by the light emitting element when the cover is located at the position at which the cover closes the opening; and a heat transfer member made of metal, the heat transfer member being attached to the heat dissipation plate and bonded to the drive integrated circuit with an adhesive having thermal conductivity to transfer the heat generated by the drive integrated circuit in a driving state to the heat dissipation plate.

2. The image forming apparatus according to claim 1, wherein the heat transfer member is a flat spring, and is fixed to the heat dissipation plate by a screw.

3. The image forming apparatus according to claim 2, wherein a part of the heat transfer member is fixed to the holding member.

4. The image forming apparatus according to claim 1, wherein a material of the adhesive includes silicon.

5. The image forming apparatus according to claim 1, wherein a direction of a pivotal axis of the cover coincides with a direction of a rotational axis of the photosensitive drum.

6. An image forming apparatus comprising:

an apparatus main body having a photosensitive drum;

a cover having a heat dissipation plate, and configured to pivot around the apparatus main body to be movable between a position at which the cover closes an opening formed on a vertical-direction upper side of the apparatus main body and a position at which the cover opens the opening;

a circuit board provided with a light emitting element that emits light for exposure of the photosensitive drum, and a drive integrated circuit that controls a voltage for driving of the light emitting element;

a holding member made of resin and holding the circuit board, the holding member being provided in the cover to enable exposure of the photosensitive drum by the light emitting element when the cover is located at the position at which the cover closes the opening; and a flat spring made of metal, the flat spring being attached to the heat dissipation plate and configured to urge the drive integrated circuit toward the circuit board by coming into contact with the drive integrated circuit to thereby transfer heat generated by the drive integrated circuit in a driving state to the heat dissipation plate.

7. The image forming apparatus according to claim 6, wherein the flat spring is fixed to the heat dissipation plate by a screw.

8. The image forming apparatus according to claim 6, wherein a part of the flat spring is fixed to the holding member.

9. An image forming apparatus comprising:

an apparatus main body having a photosensitive drum;

a cover having a heat dissipation plate, and configured to pivot around the apparatus main body to be movable between a position at which the cover closes an opening formed on a vertical-direction upper side of the apparatus main body and a position at which the cover opens the opening;

a circuit board provided with a light emitting element that emits light for exposure of the photosensitive drum, a drive integrated circuit that controls a voltage for driving of the light emitting element, and a connector to which a cable for transmission of an electric signal to each of the light emitting element and the drive integrated circuit is to be connected;

a holding member made of resin and holding the circuit board, the holding member being provided in the cover to enable exposure of the photosensitive drum by the light emitting element when the cover is located at the position at which the cover closes the opening;

a ground terminal formed at a position different from a position at which the drive integrated circuit is disposed and a position at which the connector is disposed, on a ground pattern of a circuit pattern of the circuit board; and a heat transfer member made of metal, the heat transfer member being attached to the heat dissipation plate and bonded to the ground terminal with an adhesive having thermal conductivity to thereby transfer heat generated by the ground terminal to the heat dissipation plate.

10. The image forming apparatus according to claim 9, wherein the heat transfer member is a flat spring, and is fixed to the frame by a screw.

11. The image forming apparatus according to claim 10, wherein a part of the heat transfer member is fixed to the holding member.

12. The image forming apparatus according to claim 9, wherein a material of the adhesive includes silicon.

13. An image forming apparatus comprising:

an apparatus main body having a photosensitive drum;

a cover having a heat dissipation plate, and configured to pivot around the apparatus main body to be movable between a position at which the cover closes an opening formed on a vertical-direction upper side of the apparatus main body and a position at which the cover opens the opening;

a circuit board provided with a light emitting element that emits light for exposure of the photosensitive drum, a drive integrated circuit that controls a voltage for driving of the light emitting element, and a connector to which a cable for transmission of an electric signal to each of the light emitting element and the drive integrated circuit is to be connected;

a holding member made of resin and holding the circuit board, the holding member being provided in the cover to enable the light emitting element to expose the photosensitive drum when the cover is located at the position at which the cover closes the opening;

a ground terminal formed at a position different from a position at which the drive integrated circuit is disposed and a position at which the connector is disposed, on a ground pattern of a circuit pattern of the circuit board; and a flat spring made of metal, the flat spring being attached to the heat dissipation plate and configured to press the ground terminal by coming into contact with the ground terminal to transfer heat generated by the ground terminal to the heat dissipation plate.

14. The image forming apparatus according to claim 13, wherein the flat spring is fixed to the heat dissipation plate by a screw.

15. The image forming apparatus according to claim 13, wherein a part of the flat spring is fixed to the holding member.

16. An image forming apparatus comprising:

an apparatus main body having a photosensitive drum;

a cover having a heat dissipation plate, and configured to pivot around to the apparatus main body to be movable between a position at which the cover closes an opening formed on a vertical-direction upper side of the apparatus main body and a position at which the cover opens the opening;

a circuit board provided with a light emitting element that emits light for exposure of the photosensitive drum, a drive integrated circuit that controls a voltage for driving of the light emitting element, and a connector to which a cable for transmission of an electric signal to each of the light emitting element and the drive integrated circuit is to be connected;

a holding member made of resin and holding the circuit board, the holding member being provided in the cover to enable the light emitting element to expose the photosensitive drum when the cover is located at the position at which the cover closes the opening;

a ground terminal formed at a position different from a position at which the drive integrated circuit is disposed and a position at which the connector is disposed, on a ground pattern of a circuit pattern of the circuit board; and a heat transfer member made of metal, the heat transfer member being attached to the heat dissipation plate and attached to the ground terminal to transfer heat generated by the ground terminal to the heat dissipation plate.

17. The image forming apparatus according to claim 16, wherein the heat transfer member is a flat spring, and is fixed to the heat dissipation plate by a screw.

18. The image forming apparatus according to claim 16, wherein a through-hole penetrating the circuit board is formed in the ground terminal, and the heat transfer member is fixed by a screw inserted into the through-hole.

* * * * *